US009681730B2

(12) United States Patent
Kerman et al.

(10) Patent No.: US 9,681,730 B2
(45) Date of Patent: Jun. 20, 2017

(54) FLEXIBLE TUBE WITH APPLICATOR CAP

(71) Applicant: ALBEA SERVICES, Gennevilliers (FR)

(72) Inventors: Eric Kerman, Chalon en Champagne (FR); Thomas Bonnin, Pronleroy (FR)

(73) Assignee: Albea Services, Gennevilliers (FR)

( * ) Notice: Subject to any disclaimer, the term of this patent is extended or adjusted under 35 U.S.C. 154(b) by 0 days.

(21) Appl. No.: 14/383,637

(22) PCT Filed: Mar. 8, 2013

(86) PCT No.: PCT/EP2013/054796
§ 371 (c)(1),
(2) Date: Sep. 8, 2014

(87) PCT Pub. No.: WO2013/135593
PCT Pub. Date: Sep. 19, 2013

(65) Prior Publication Data

US 2015/0020841 A1 Jan. 22, 2015

(30) Foreign Application Priority Data

Mar. 15, 2012 (FR) ..... 12 52352

(51) Int. Cl.
*A45D 34/04* (2006.01)
*A45D 40/26* (2006.01)
(Continued)

(52) U.S. Cl.
CPC ..... *A45D 34/045* (2013.01); *A45D 34/046* (2013.01); *A45D 40/265* (2013.01); *A46B 11/0065* (2013.01); *A45D 2034/007* (2013.01)

(58) Field of Classification Search
CPC ..... A46B 2200/1053; A46B 11/0041; A46B 11/0065; A45D 33/00; A45D 34/00;
(Continued)

(56) References Cited

U.S. PATENT DOCUMENTS 4,659,408 A * 4/1987 Redding ..... 428/461
4,919,984 A * 4/1990 Maruhashi et al. ..... 428/36.4
(Continued)

FOREIGN PATENT DOCUMENTS

EP 2202042 A1 6/2010
FR 2879418 A1 6/2006
JP 2006069581 A 3/2006

OTHER PUBLICATIONS

International Preliminary Examination Report with translation of the Written Opinion dated Sep. 16, 2014 (PCT/EP2013/054796); ISA/EP.

(Continued)

*Primary Examiner* — Todd E Manahan
*Assistant Examiner* — Jennifer Gill
(74) *Attorney, Agent, or Firm* — Banner & Witcoff, Ltd.

(57) ABSTRACT

A container (1) has an applicator cap (2) for a cosmetic product and a flexible tube (3) having a skirt (31) and a tube head (32) having a shoulder part (321) and a neck (322) with an opening (3221), The tube head (32) is connected to the skirt (31) by the shoulder part (321). The flexible tube (3) acting as a reservoir to contain some cosmetic product. The applicator cap (2has a base (21) and an applicator, the base (21) being designed to fix onto the tube head (32) and plug the opening (3221) and the applicator being fixed to the base (21) so as to be housed inside the flexible tube (3) when the base (21) is fixed to the tube head (32) and plugs the opening (3221). The skirt (2) is made of a multilayered plastics material (4) comprising at least one barrier layer (41).

14 Claims, 1 Drawing Sheet

(51) Int. Cl.
*A46B 11/00* (2006.01)
*A45D 34/00* (2006.01)

(58) Field of Classification Search
CPC .... A45D 34/045; A45D 34/04; A45D 34/042; A45D 40/26; A45D 40/262; A45D 40/264; A45D 40/265; A45D 29/00; A45D 29/007; A45D 34/046; A45D 2034/007
USPC .... 132/218, 73, 312, 317, 318, 320; 401/38, 401/118, 123–130, 156, 183, 185, 192; 220/62.11, 62.19, 62.22, 613, 666; 222/92, 107
See application file for complete search history.

(56) References Cited

U.S. PATENT DOCUMENTS 5,012,944 A * 5/1991 Scheurenbrand ... B29C 49/4817 220/677
5,061,534 A * 10/1991 Blemberg ..... B29C 47/145 206/484
5,230,934 A * 7/1993 Sakano et al. ..... 428/35.7
5,238,148 A * 8/1993 Holoubek ..... B32B 27/08 220/667
5,743,279 A * 4/1998 Gueret ..... 132/218
5,862,818 A * 1/1999 Marinelli ..... 132/312
6,029,676 A * 2/2000 Dumler ..... A45D 34/046 132/218
6,042,906 A * 3/2000 Itoh ..... B32B 27/32 428/35.2
6,158,912 A * 12/2000 Miraglia et al. ..... 401/129
6,210,060 B1 * 4/2001 Gueret ..... 401/129
6,218,024 B1 * 4/2001 Tamber ..... B29C 47/0021 428/35.4
6,313,221 B1 * 11/2001 Yabuta ..... C08G 59/4207 525/117
6,447,860 B1 * 9/2002 Mueller et al. ..... 428/36.6
6,572,296 B2 * 6/2003 Schrepf ..... 401/122
6,632,493 B1 * 10/2003 Hildebrand et al. ..... 428/35.7
6,670,007 B1 * 12/2003 Safian et al. ..... 428/36.91
6,755,585 B2 * 6/2004 Gueret ..... 401/125
7,223,035 B1 * 5/2007 Engel ..... A45D 40/267 401/122
7,252,878 B2 * 8/2007 Watanabe ..... B32B 27/08 428/336
7,810,510 B2 * 10/2010 Tranchant ..... 132/218
7,845,871 B2 * 12/2010 Thiebaut ..... 401/17
8,967,897 B2 * 3/2015 Apodaca ..... A45D 34/04 401/184
2002/0057939 A1 * 5/2002 Gueret ..... 401/126
2003/0172950 A1 9/2003 Bouix et al.
2005/0011892 A1 * 1/2005 Nakajima et al. ..... 220/62.22
2006/0045605 A1 * 3/2006 Deans et al. ..... 401/126
2006/0046006 A1 * 3/2006 Bastion et al. ..... 428/35.2
2006/0094810 A1 * 5/2006 Kim ..... B32B 1/02 524/445
2006/0272670 A1 * 12/2006 Gueret ..... 132/317
2007/0087145 A1 * 4/2007 Hanita ..... C08L 67/02 428/35.7
2009/0269121 A1 * 10/2009 Snedden et al. ..... 401/183
2010/0129577 A1 * 5/2010 Sasai et al. ..... 428/36.7
2010/0176136 A1 * 7/2010 Lacoste et al. ..... 220/660
2010/0226705 A1 * 9/2010 Crutchley ..... 401/122
2013/0260069 A1 * 10/2013 Wang et al. ..... 428/35.9
2013/0315646 A1 * 11/2013 Stredak et al. ..... 401/118

OTHER PUBLICATIONS

International Search Report and Written Opinion dated May 10, 2013 (PCT/EP2013/054796); ISA/EP.

* cited by examiner

FLEXIBLE TUBE WITH APPLICATOR CAP

CROSS-REFERENCE TO RELATED APPLICATIONS

The present application is a U.S. National Phase filing of International Application No. PCT/EP2013/054796, filed on Mar. 8, 2013, designating the United States of America and claiming priority to French Patent Application 1252352 filed Mar. 15, 2012, and this application claims priority to and the benefit of the above-identified applications, which are both incorporated by reference herein in their entireties.

TECHNICAL FIELD

The present invention relates to the field of containers for cosmetic products. In particular, the present invention relates to the field of containers with an applicator cap.

BACKGROUND OF THE INVENTION

There are containers with applicator caps for cosmetic products. The cosmetic products in question are generally nail varnishes, mascara, liquid liner (more often known as "eye-liner") and lip gloss (sometimes simply called "gloss").

A container with an applicator cap for nail varnish usually takes the form of a transparent glass bottle acting as a reservoir for the nail varnish. The bottle comprises an opening within which a straight applicator brush can be contained and can pass, said brush being fixed to the end of a rod, which is fixed in turn to the cap.

A drawback of this type of nail varnish container is the weight involved in using glass.

A container with an applicator cap for mascara usually takes the form of a rigid cylindrical tube, generally made of polypropylene, acting as a reservoir for the mascara. The cylindrical tube comprises an opening within which a round applicator brush can be contained and can pass, said brush being fixed to the end of a rod, which is fixed in turn to the cap.

A container with an applicator cap for liquid liner generally has the same shape and design as a container with an applicator cap for mascara, except that the round applicator brush is replaced by a straight applicator brush.

A container with an applicator cap for lip gloss generally has the same shape and design as a container with an applicator cap for mascara, except that the round applicator brush is replaced by an applicator pad.

A drawback of this type of container is that some of the cosmetic product becomes inaccessible for transfer to the applicator, accumulates inside the cylindrical tube around the opening, and dries out there.

Furthermore, it would be advantageous to be able to have a single type of container with an applicator cap for all these different types of cosmetic; then only the applicator cap would differ.

In order to take into account the disposable nature of the container, it is advantageous for the container to be made with inexpensive materials, a small number of manufacturing steps and automatable production methods.

SUMMARY

One objective of the present invention is to mitigate at least one of the drawbacks of the prior art. In particular, one objective of the present invention is to propose a container with an applicator cap which is equally suitable for nail varnish, mascara, liquid liner and lip gloss.

Another objective is to propose a lighter nail varnish container.

Yet another objective is to propose a container for mascara, liquid liner and lip gloss which allows optimal use of the quantity of cosmetic product contained in the reservoir.

For this purpose, the present invention proposes a container with an applicator cap for a cosmetic product, comprising:

- a flexible tube having a skirt and a tube head comprising a shoulder portion and a neck with an opening, the tube head being connected to the skirt by the shoulder portion, the flexible tube acting as a reservoir for containing cosmetic product;
- an applicator cap having a base and an applicator, the base being designed to be fixed to the tube head and to close the opening, and the applicator being fixed to the base so as to be housed inside the flexible tube when the base is fixed to the tube head and closes the opening;

characterised in that the skirt is made of a multilayered plastics material comprising at least one barrier layer.

Such a container can be used for a diverse range of cosmetic products. Indeed, the shape of the container and the composition of the tube are compatible with nail varnishes, mascaras, liquid liners and lip glosses.

Other optional and non-limiting features are:

- the materials used for the various layers are selected so as to have a translucent, and in particular transparent, skirt;
- the barrier layer(s) are made of a material selected from: ethylene-vinyl alcohol (EVOH), polyacrylonitrile, polyvinyl chloride or polyamide;
- the barrier layer(s) are made of EVOH;
- the barrier layer(s) are positioned symmetrically within the multilayered material;
- the cumulative thickness of the barrier layer(s) is less than 40 μm, preferably less than or equal to 34 μm, more preferably less than or equal to 30 μm;
- the cumulative thickness of the barrier layer(s) is at least 10 μm, preferably greater than 15 μm, more preferably greater than 20 μm;
- the multilayered material further comprises an outer layer of varnish, preferably a varnish composed of a mixture of epoxy and acrylic resin cross-linked by ultraviolet light or a thermal varnish such as a mixture comprising 2-butoxyethyl acetate, n-butyl acetate, polyacrylate and polymethylhydrosiloxane;
- the multilayered material further comprises two supporting layers;
- the supporting layers are arranged symmetrically with respect to the barrier layer(s);
- the supporting layers are formed by the same component and/or have the same thickness;
- the multilayered material is coextruded, in particular using a binder;
- the multilayered material is formed of concentric layers, each layer covering the whole contour of the skirt;
- the supporting layers are made of high-density polyethylene (HDPE), low-density polyethylene (LDPE), metallocene polyethylene or combined layers produced by mixing linear low-density polyethylene (LLDPE) and HDPE, or LDPE and HDPE, or LLDPE and metallocene polyethylene, or HDPE and metallocene polyethylene, preferably combined layers produced by mixing LLDPE and metallocene polyethylene;

the supporting layers are made of homo-polypropylene (homo-PP), co-polypropylene (co-PP), polypropylene random (PPR), metallocene polypropylene or combined layers produced by mixing, and can be composed of a mixture of homo-PP and co-PP, or a mixture of homo-PP and PPR, or a mixture of co-PP and PPR, preferably a mixture of metallocene polypropylene and polypropylene selected from homo-PP, co-PP or PPR;

the thickness of the supporting layers is at most 400 μm, preferably less than 300 μm, more preferably less than 200 μm;

the thickness of the supporting layers is at least 100 pm, preferably greater than 150 μm, more preferably greater than 170 μm;

the applicator cap and the neck are designed to cooperate with one another in a screwing relationship so as to close the opening.

the applicator is a nail varnish applicator and, in this case, the barrier layer is optionally made of EVOH with a thickness of at least 20 μm;

the applicator is a mascara applicator, in which case the container can further comprise a built-in wiper, the built-in wiper and the flexible tube being made of the same, single piece of material; and where the applicator is a mascara applicator, the barrier layer can be made of EVOH having a thickness of at least 10 μm, preferably at least 15 μm.

BRIEF DESCRIPTION OF THE DRAWINGS

Other objectives, features and advantages will become apparent upon reading the following detailed description with reference to the drawings given by way of example and in a non-limiting manner, in which.

DETAILED DESCRIPTION

Figure 1:
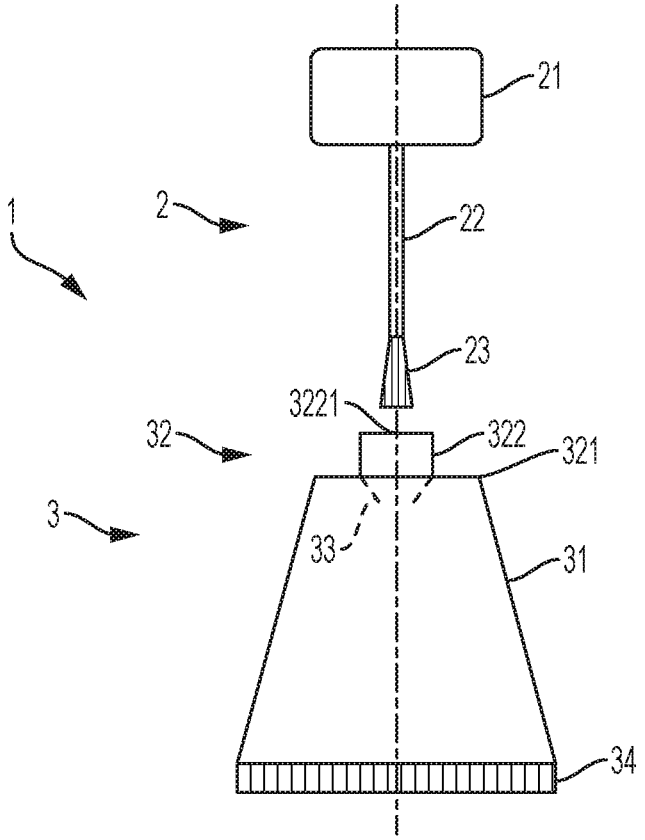
FIG. 1 is a schematic view of a container with an applicator cap.
Figure 2:
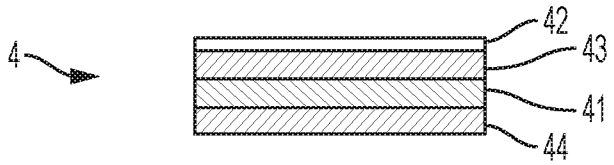
FIG. 2 is a schematic view of a multilayered material which is suitable for manufacturing the container having an applicator cap.
Figure 3:
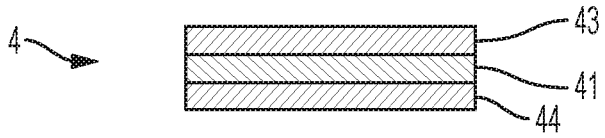
FIG. 3 is a schematic view of a multilayered material which is suitable for manufacturing the container having an applicator cap.

A container with an applicator cap for cosmetic product is described below with reference to FIG. 1.

This container 1 comprises a flexible tube 3 having a skirt 31 and a tube head 32. The tube head 32 comprises a shoulder part 321 which is connected to a neck 322 having an opening 3221. The tube head 32 is connected to the skirt 31 by the shoulder part 321. The flexible tube 3 acts as a reservoir for containing the cosmetic product.

The term "flexible tube" is to be understood in the context of the invention as a container that can be deformed under pressure exerted on its outer surface by the user.

The flexible tube 3 can be made from a tube with a circular, oval or elliptical cross section, forming the skirt 31. The tube is cut transversely at the two ends thereof. One end 34 is sealed by compression perpendicular to a diameter of the cross section of the tube and by making a seam at this end to seal it against the cosmetic product.

The skirt 31 is made of a multilayered plastics material 4 comprising at least one barrier layer 41. The multilayered material 4 must allow a percentage loss of weight of the cosmetic product in four weeks of less than 1%.

The barrier layer(s) 41 can be made of a material selected from: ethylene-vinyl alcohol (EVOH), polyacrylonitrile (PAN), polyvinyl chloride (PVC) or polyamide (PA), and preferably EVOH.

The barrier layer 41 makes it possible to avoid evaporation of volatile compounds contained in the cosmetic products. For example, for nail varnishes, the solvent is an alcohol solvent and is therefore very volatile. In particular, nail varnishes mainly have ethyl acetate and/or butyl acetate as the volatile component. These two components usually represent around 70% by weight of the nail varnish. Another volatile component that can be contained in a nail varnish is isopropanol. Nail varnishes are usually contained in glass containers because the solvent they contain can pass through the walls of flexible tubes made of organic material. Other volatile compounds can be involved, such as the aromatic compounds present in lip glosses, or formaldehyde.

The materials constituting the barrier layer(s) constitute a non-negligible proportion of the cost of materials. The aim is therefore to reduce the thickness of barrier layer used while preserving their function of preventing the evaporation of the volatile compounds. In the case of a single barrier layer 41, the thickness of the barrier layer 41 is preferably less than 40 μm, preferably less than or equal to 34 μm, more preferably less than or equal to 30 μm. In the case of multiple barrier layers 41, the sum of the thicknesses of the barrier layers is less than 40 μm, preferably less than or equal to 34 μm, more preferably less than or equal to 30 μm.

In the case of a single barrier layer 41, made of EVOH and where the applicator is a nail varnish applicator, the thickness of the barrier layer 41 is preferably at least 20 μm. In the case of multiple barrier layers 41 made of EVOH and where the applicator is a nail varnish applicator, the sum of the thicknesses of the barrier layers 41 is preferably at least 20 μm.

In the case of a single barrier layer 41, made of EVOH and where the applicator is an applicator for mascara, liquid liner or lip gloss, the thickness of the barrier layer 41 is preferably at least 10 μm, more preferably at least 15 μm. In the case of multiple barrier layers made of EVOH and where the applicator is a mascara, liquid liner or lip gloss applicator, the sum of the thicknesses of the barrier layers 41 is preferably at least 10 μm, more preferably at least 15 μm.

The barrier layer(s) 41 can be positioned symmetrically within the multilayered material 4, i.e. with respect to a mid-plane of the multilayered material 4.

The multilayered material 4 can further comprise an outer layer of varnish 42, preferably a varnish composed of a mixture of epoxy and acrylic resin cross-linked by ultraviolet (UV) light or a thermal varnish such as a mixture comprising 2-butoxyethyl acetate, n-butyl acetate, polyacrylate and polymethylhydrosiloxane. The term "thermal varnish" is understood to mean a thermally cross-linked varnish. In this case, the mixture can comprise approximately 39% by weight 2-butoxyethyl acetate, approximately 19% by weight n-butyl acetate, approximately 30% by weight polyacrylate, approximately 10% by weight polymethylhydrosiloxane and water q.s. to 100%. This makes it possible to improve the translucency of the skirt 31, or even to make it translucent.

The multilayered material 4 can be printed by offset printing, screen printing or hot stamping. In this case, it is useful to leave a non-printed window through which the colour of the product can be seen. Where the multilayered material 4 comprises a layer of varnish, printing is done before applying this layer of varnish.

Furthermore, the multilayered material 4 can also comprise two supporting layers (an outer supporting layer 43 and an inner supporting layer 44 respectively). The outer 43 and inner 44 supporting layers can be made of high-density polyethylene (HDPE) or low-density polyethylene (LDPE) or metallocene polyethylene or combined layers. The combined layers are layers produced by mixing and can be composed of a mixture of linear low-density polyethylene (LLDPE) and HDPE, preferably in ratios ranging from 30/70 to 70/30 (PEBDL/HDPE) and in particular 30/70, 50/50 and 70/30. The combined layers can also be composed of a mixture of LDPE and HDPE, preferably in ratios ranging from 30/70 to 70/30 (LDPE/HDPE) and in particular 30/70, 50/50 and 70/30. The combined layers can also be composed of a mixture of LLDPE and metallocene polyethylene, preferably in ratios ranging from 30/70 to 70/30 (LLDPE/metallocene polyethylene) and in particular 30/70, 50/50 and 70/30. The combined layers can also be composed of a mixture of HDPE and metallocene polyethylene, preferably in ratios ranging from 30/70 to 70/30 (HDPE/metallocene polyethylene) and in particular 30/70, 50/50 and 70/30. The outer 43 and inner 44 supporting layers can be made of homo-polypropylene (homo-PP), co-polypropylene (co-PP), polypropylene random (PPR), metallocene polypropylene or combined layers. The combined layers are layers produced by mixing and can be composed of a mixture of homo-PP and co-PP, or a mixture of homo-PP and PPR, or a mixture of co-PP and PPR, preferably a mixture of metallocene polypropylene and polypropylene selected from homo-PP, co-PP or PPR, preferably in ratios ranging from 30/70 to 70/30 and in particular 30/70, 50/50 and 70/30.

The supporting layers are preferably made of HDPE.

The thickness of the supporting layers can be at most 400 μm, preferably less than 300 μm, more preferably less than 200 μm. It is of interest to reduce the thickness of the supporting layers. This makes it possible to improve the translucency of the skirt 31, or even to make it translucent. Where the supporting layers comprise metallocene polyethylene or metallocene polypropylene alone or in combined layers, reducing the thickness of the skirt 31 makes it possible to improve its transparency or even to make it transparent. Reducing the thickness of the skirt 31 also allows the flexibility of the skirt 31 to be improved, and its weight reduced. The thickness of the supporting layers can be at least 100 μm, preferably greater than 150 μm, more preferably greater than 170 μm. The supporting layer contributes to preserving the product and to the protection offered by the barrier layer(s).

In these cases, the barrier layer 41 is contained between the two supporting layers 43, 44. The three layers 41, 43 and 44 are coextruded using a binder (or glue), for example a binder based on anhydride-modified polyolefin. The binder has no influence on the weight loss of the cosmetic product. Coextrusion makes it possible to produce the skirt without a longitudinal seam, which could represent a potential risk of the product leaking.

The container 3 also comprises an applicator cap 2 having a base 21, a rod 22 and an applicator tip 23. The base 21 is designed to be fixed to the tube head 32 and to close the opening 3221. The base 21 and the neck 322 are preferably provided with helical threads capable of cooperating with one another in a screwing relationship so as to close the opening 3221. The threads maintain the sealing of the closure of the opening 3221.

The rod 22 extends from the base 21 so that it can be housed inside the flexible tube 3 when the base 21 is fixed to the tube head 32 and closes the opening 3221. The rod 22 and the applicator tip 23 are designed to be able to pass through the opening 3221 of the neck 322. The rod 22 can be made in a single piece with the base 21 or fixed thereto.

The base 21 and the rod 22 ensure that the tube head 32 is sealed against fluids. Sealing can be effected by compression, exerted by a collar of the base 21, of a knurled portion housed in the base 21 over the top of the tube head 32. The knurled portion is compressed against the rod 22. Sealing can also be effected by fitting a small skirt on the base 21 into the opening 3221 of the neck 322. The applicator tip 23 to which the cosmetic product is temporarily transferred before application to part of the user's body can be a straight brush fixed to the rod 21, which is advantageous for nail varnishes and liquid liners. The straight brush can be a tuft of fibres fixed to the rod by anchoring into metal. In particular, use is made of nylon fibres with a diameter of between 25 and 300 μm, preferably between 50 and 100 μm. The tip of the applicator 23 can also be a round brush for mascara or a pad for lip gloss.

In the case of mascara, the container can further comprise a built-in wiper 33, the built-in wiper 33 and the flexible tube 3 being made of the same, single piece of material.

Measurement

A test for measuring the percentage of weight loss in four weeks of a cosmetic product, in this case nail varnish, through a multilayered material forming a flexible tube, is described below.

At least two identical flexible tubes are filled with nail varnish and hermetically sealed with a cap against water and air. The flexible tubes have an inner contact surface with the nail varnish of approximately 30 $cm^2$. The composition of the nail varnish comprises ethyl and/or butyl acetate at approximately 70% by weight.

The weight of the two filled flexible tubes and an empty flexible tube (control) which is identical to the other two flexible tubes is measured. The three tubes being sealed when measured.

The three flexible tubes are placed in a heat chamber heated to 40° C.

After four weeks, the weight of the three flexible tubes is measured again.

The percentage loss of mass is calculated according to formula 1. The percentage weight loss represents the loss of weight of nail varnish.

$$\%\ \text{loss of weight} = \frac{(\text{weight at 4 weeks} - \text{initial weight})}{\text{initial weight}} \qquad \text{Formula 1}$$

EXAMPLE 1

An example of multilayered material suitable for manufacturing the skirt of the flexible tube is described below.

This multilayered material is a coextruded material comprising, from the outside inwards, the following successive layers:

- a layer of varnish composed of a mixture of epoxy and acrylic resins cross-linked by UV light;
- a layer of high-density polyethylene which is 170 μm thick;
- a layer of binder with a thickness of between 10 and 30 μm;
- a layer of ethylene-vinyl alcohol which is 25 μm thick;

a layer of binder with a thickness of between 10 and 30 μm; and a layer of high-density polyethylene which is 170 μm thick.

This multilayered material makes it possible to obtain a container with an applicator for which the percentage weight loss at four weeks for a nail varnish is 0.87%.

EXAMPLE 2

Example 2 of multilayered material is similar to example 1, except that the thickness of the EVOH layer is different. Said EVOH layer is 33 μm thick.

This multilayered material makes it possible to obtain a container with an applicator cap for which the percentage weight loss at four weeks for a nail varnish is 0.7%.

EXAMPLE 3

Example 3 of multilayered material is similar to example 1. However, the layers of HDPE are replaced with layers of LLDPE/HDPE which are 170 μm thick and the layer of EVOH has a thickness of 26 μm.

This multilayered material makes it possible to obtain a container with an applicator cap for which the percentage weight loss at four weeks for a nail varnish is 0.63%.

EXAMPLE 4

Example 4 of multilayered material is similar to example 1. However, the layers of HDPE are replaced with layers of co-PP which are 170 μm thick and the layer of EVOH has a thickness of 25 μm.

This multilayered material makes it possible to obtain a container with an applicator cap for which the percentage weight loss at four weeks for a nail varnish is 0.55%.

EXAMPLE 5

Example 5 of multilayered material is similar to example 1. However, the layers of HDPE are replaced with layers of LLDPE/metallocene PE which are 170 μm thick and the layer of EVOH has a thickness of 25 μm.

This multilayered material makes it possible to obtain a container with an applicator cap for which the percentage weight loss at four weeks for a nail varnish is 0.67%.

COMPARATIVE EXAMPLES

Three comparative examples have been produced and are similar to the multilayered material in example 1. The differences are summarised in the table below:

| | Outer layer of varnish | Thickness of EVOH (μm) | % loss of weight at 4 weeks |
|---|---|---|---|
| Example 6 | epoxy | 34 | 1.22 |
| Example 7 | acrylate resins | 30 | 1.38 |
| Example 8 | epoxy/acrylic resin mixture | 16 | 1.88 |

A fourth comparative example is produced.

The multilayered material of the fourth example comprises, from the inside outwards:

a first supporting layer made of HDPE which is 90 μm thick;

a first binder layer made of ethylene-acrylic acid (EAA) copolymer which is 40 μm thick;

a layer of aluminium which is 18.6 μm thick acting as a barrier layer;

a second binder layer made of EAA copolymer which is 40 μm thick; and a second supporting layer made of LDPE which is 315 μm thick.

The measured weight loss at four weeks of the nail varnish for this example is 3.3%.

The weight loss at 4 weeks of the empty tube is, in each of the above examples, 0.02%.

The invention claimed is:

1. Container with an applicator cap for a cosmetic product, comprising:

a flexible tube having a skirt and a tube head comprising: a shoulder portion and a neck with an opening, the tube head being connected to the skirt by the shoulder portion, the flexible tube acting as a reservoir for containing cosmetic product;

an applicator cap having a base and an applicator, the base being designed to be fixed to the tube head and to close the opening, and the applicator being fixed to the base so as to be housed inside the flexible tube when the base is fixed to the tube head and closes the opening;

characterised in that the skirt is made of a multilayered plastics material comprising at least one barrier layer and an outermost layer of varnish; wherein a cumulative thickness of the at least one barrier layer is at least 10 μm, and less than 40 μm, and wherein the varnish is composed of a mixture of epoxy and acrylic resin cross-linked by ultraviolet light or a thermal varnish comprising 2-butoxyethyl acetate, n-butyl acetate, polyacrylate and polymethylhydrosiloxane; and one end of the skirt is sealed with a seam made by compression.

2. Container according to claim 1, wherein the at least one barrier layer is made of a material selected from: ethylene-vinyl alcohol, polyacrylonitrile, polyvinyl chloride or polyamide.

3. Container according to claim 2, wherein the at least one barrier layer is made of ethylene-vinyl alcohol.

4. Container according to claim 1, wherein the multilayered material comprises two supporting layers, wherein the at least one barrier layer is between the two supporting layers.

5. Container according to claim 4, wherein the multilayered material is coextruded using a binder between the at least one barrier layer and the two supporting layers.

6. Container according to claim 4, wherein the two supporting layers are made of HDPE, LDPE, metallocene polyethylene or combined layers produced by mixing LLDPE and HDPE, or LDPE and HDPE, or LLDPE and metallocene polyethylene, or HDPE and metallocene polyethylene.

7. Container according to claim 1, wherein the applicator is a brush for a nail varnish applicator.

8. Container according to claim 7, wherein the at least one barrier layer is made of ethylene-vinyl alcohol with a thickness of at least 20 μm and less than 40 μm.

9. Container according to claim 1, wherein the applicator is brush for a mascara applicator.

10. Container according to claim 9, further comprising a built-in wiper, the built-in wiper and the flexible tube being made of a same, single piece of material.

11. Container according to claim 9, wherein the at least one barrier layer is made of ethylene-vinyl alcohol.

12. Container according to claim 6 wherein the two supporting layers are combined layers produced by mixing LLDPE and metallocene polyethylene.

13. Container according to claim 11, wherein the at least one barrier layer is made of ethylene-vinyl alcohol having a thickness of at least 15 μm.

14. Container according to claim 4, wherein the two supporting layers are arranged symmetrically with respect to the at least one barrier layer.

* * * * *